United States Patent [19]

Belbel et al.

[11] Patent Number: 4,635,022

[45] Date of Patent: Jan. 6, 1987

[54] FUSE CUT-OUT CARTRIDGE

[75] Inventors: Elie Belbel, Epinay sur Seine; Thierry Baron; Christian Blanchard, both of Rueil Malmaison; André Haury, Le Raincy; Michel Lauraire, Courbevoie, all of France

[73] Assignee: La Telemecanique Electrique, France

[21] Appl. No.: 820,296

[22] Filed: Jan. 21, 1986

[30] Foreign Application Priority Data

Jan. 23, 1985 [FR] France ..... 85 00915

[51] Int. Cl.[4] ..... H01H 85/04; H01H 85/38

[52] U.S. Cl. ..... 337/158; 337/4; 337/220; 337/273; 200/151

[58] Field of Search ..... 337/4, 5, 142, 150, 337/220, 273, 278, 281, 282, 158; 200/151, 61.08

[56] References Cited

U.S. PATENT DOCUMENTS 2,854,551 9/1958 Lange ..... 337/282

*Primary Examiner*—Harold Broome

[57] ABSTRACT

A fuse cartridge for example of the cylindrical type comprising an insulating cylindrical body ending in two conducting end pieces and a fuse element connected electrically to the end pieces, further comprising two pistons housed in the body which are movable in translation in opposite directions to each other and collect the gases released by the electric arc at the time of its appearance, so that the pressure of the gases exerts on each piston a force which causes it to move towards a position in which the arc is totally sheared.

16 Claims, 8 Drawing Figures

1
2
3
4
5
6
7
8
9
9'
10
12
16
18
19
20
25
45
47
48
50
51
54
55
56
57
59
60
A
B
X
X'

1
2
3
4
5
6
9
16
18
25
45a
45b
47
48
50
51
54
55
56
57
59
60
X
X'

FUSE CUT-OUT CARTRIDGE

BACKGROUND OF THE INVENTION

1. Field of the Invention

The present invention relates to an electric fuse cut-out circuit of the cylindrical type or knife type.

2. Description of the Prior Art

Different fuse cartridge structures are already known used for protecting electric apparatus against over currents and short circuits. One of them, of cylindrical type, comprises a cylindrical insulating body ending in two conducting capsules or caps, also called end pieces, and in which is disposed, on the one hand, a fuse wire connected electrically to the two end pieces and, on the other a sand filling whose purpose is to dissipate the electric arc energy created on the appearance of an overcurrent or a short circuit. In fact, in the presence of this type of electric fault, the fuse wire splits into two parts between which an electric arc is created which causes both the sand and the fuse wire to melt. By melting the sand cools the arc so as to extinguish it completely, thus breaking the electric circuit.

Another known fuse cartridge structure, this time of the knife type, and operating in an identical way to that described above comprises, on the one hand, an insulating body of a substantially parallelepipedic shape in which are disposed, as before, the fuse element (blade or strip) and the sand and, on the other hand, two end pieces or conducting knives provided perpendicularly on two opposite end faces of the body and connected electrically to the fuse element.

However, these fuse cartridge structures, whether cylindrical or with knives, have drawbacks. In fact, correct operation of the fuse cartridge implies among other things that the sand is pure and that its grain size is very precise for it varies depending on each type of cartridge. Such conditions require then numerous checks and measurements which are time consuming and complicated to carry out. In addition, the fact of having sand does not guarantee for the fuse cartridge a total insulation between the two parts of the fuse element once split.

SUMMARY OF THE INVENTION

The aim of the present invention is to overcome these drawbacks by providing a fuse cartridge, of the cylindrical or knife type, which is simple to construct, no longer requires any sand filling, has excellent performances with a high cut-out power and particularly complete insulation and allows a fuse element with reduced section to be provided solely in the arc formation chamber.

For this, the invention provides a fuse cartridge, of the cylindrical or knife type, which is characterized in that it comprises:

two insulating pistons housed in the cartridge body, parallel to the axis thereof and movable in translation oppositely to each other between a rest position taken before appearance of an electric arc and a position in which the arc is sheared, the two pistons being pierced laterally respectively with two orifices coming opposite each other and having passing therethrough a reduced section portion of the fuse element when these pistons are in the rest position, each orifice communicating with an expansion volume space defined inside the associated piston and intended to collect the gases produced when the fuse element melts, so that when the electric arc appears in the orifices, the pressure of the gases released by the arc exerts on each of the pistons a force which causes them to move in opposite directions towards the position where the arc is sheared;

stop forming means housed in the body and associated with each piston for receiving it at the end of travel;

means for removing the gases after propulsion of each piston.

It will thus be understood that the electric arc will be sheared by the movement of each of the pistons propelled in opposite directions by the energy of the arc itself; in addition, with this arrangement of the two pistons parallel to the axis of the cartridge, the insulation between the two parts of the split fuse element is total at the end of travel of each piston.

BRIEF DESCRIPTION OF THE DRAWINGS

Other features and advantages of the invention will be clearer from the detailed description which follows with reference to the accompanying drawings, given solely by way of example and in which.

In these different Figures, the same references refer to the same elements which fulfill the same functions with a view to obtaining the same results.

DESCRIPTION OF THE PREFERRED EMBODIMENT

Figure 1:
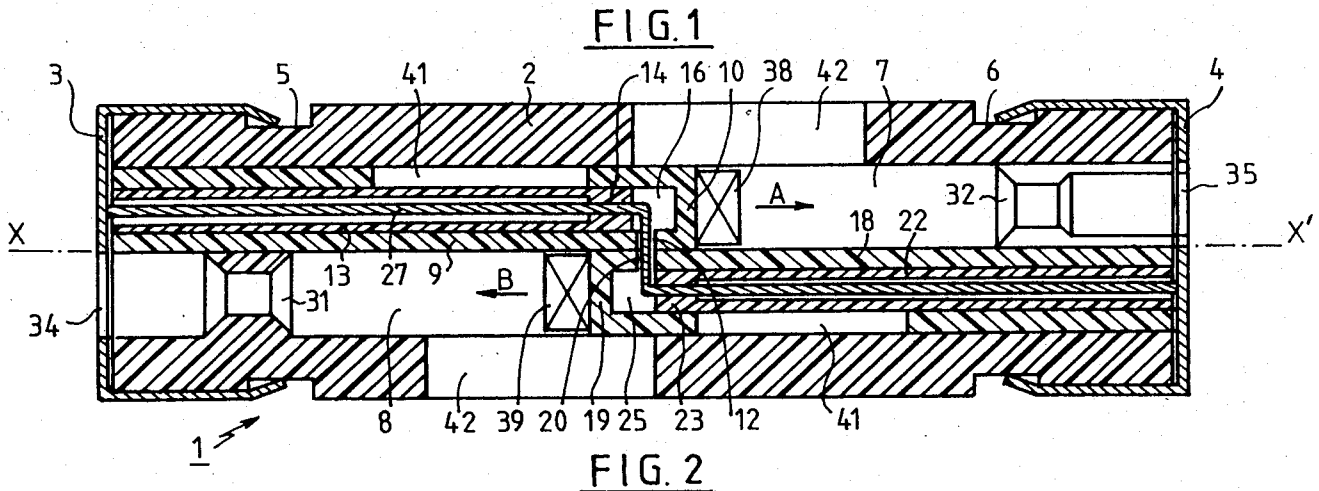
FIGS. 1 and 2 show longitudinal sectional views of a first embodiment of a fuse cartridge of the cylindrical type in accordance with the invention, respectively with the pistons in the rest and end of travel positions.

FIG. 1 shows in section a fuse cartridge of the cylindrical type 1 in a first embodiment of the invention. This fuse cartridge, with a rating for example of 12A/220 or 380 V, comprises a cylindrical body 2 made from an insulating material, with axis XX', ending at both ends in two identical end pieces in the form of sockets or caps 3 and 4, made from a conducting material such for example as silver coated copper and fixed to the body for example by crimping in two annular grooves 5 and 6 formed at the ends thereof.

Body 2 defines inwardly two identical cylindrical housings, referenced at 7 and 8, parallel to axis XX' and formed on each side of this axis and over the whole length of the body, and communicating with each other at the level of the axis XX'.

In the housing 7 of the body is disposed a first mobile insulating material piston 9 of a length less than that of the housing so that it may move therein with translational motion parallel to the axis XX', and being in the form of a cylindrical sleeve having a bottom 10. In the rest position, i.e. before the appearance of an arc, such as illustrated in FIG. 1, piston 9 is introduced by its bottom 10 into its housing so as to be flush with the end face of the body on the end piece 3 side. The cylindrical piston 9 is further pierced laterally and in the vicinity of its bottom 10 with an orifice 12 which is placed on the axis XX' side during fitting of the piston in its housing.

Inside piston 9 is inserted longitudinally with a slight play a first fixed insulating material piece formed by another cylindrical sleeve 13 coaxial with sleeve 9 and also having a bottom 14 which is pierced with a central opening. This sleeve 13 is fitted by its bottom 14 into the associated sleeve 9 and has a length less than that of sleeve 9 so as to define between their respective bottoms 10 and 14 an internal space 16 of variable volume, so called gas expansion space, which communicates with the orifice 12 of sleeve 9.

Similarly, as is apparent from FIG. 1, a second mobile piston 18 identical to the first one, i.e. formed by a cylindrical insulating sleeve with a bottom 19 and pierced laterally with an orifice 20, is disposed in the housing 8 of the body so as to be able to move therein with a translational motion but in the opposite direction to the first piston 9. Thus, in the rest position illustrated in FIG. 1, piston 18 is disposed on the end piece 4 side and is positioned longitudinally and with a small clearance with respect to piston 9 so that their respective orifices 12 and 20 are placed opposite each other.

A second fixed piece 22, identical to the first one, i.e. formed by a cylindrical insulating sleeve having a bottom 23 pierced with a central opening, is inserted longitudinally in the associated piston 18 so as to define between their respective bottoms 19 and 23 an internal space 25 of variable volume communicating with the orifice 20.

Thus, in the rest position (FIG. 1) the two pistons 9 and 18 are arranged in the body oppositely on each side of its axis XX' and are disposed with respect to each other along this axis so as to place their respective orifices in direct communication.

A fuse element formed by a wire 27 made from a conducting material such for example as silver coated copper is connected electrically at both its ends, for example by soldering, to the two end pieces 3 and 4 of the cartridge. Thus, as can be clearly seen in FIG. 1, the fuse wire passes longitudinally through each of the two sleeves 13 and 22 serving then as support for said wire, and passes through the facing orifices 12 and 20 of the pistons as well as through the two spaces of variable volume 16 and 25. In addition, where it passes through these orifices and these spaces the fuse wire 27 preferably has a reduced section.

Thus, when an overcurrent or a short circuit appears, the fuse wire 27 melts at the level of its reduced section portion and is split into two parts, and there is formed therebetween, i.e. in the chamber defined by the two orifices and the two internal spaces an electric arc whose energy is collected in each of the internal spaces 16 and 25. Then, the pressure of the gases released by the arc and received by the two pistons 9 and 18 exerts, on each of these latter, a force which very rapidly causes their axial movements in opposite directions to each other, in the direction of arrows A and B in FIG. 1, thus causing shearing of the arc.

It will be noted that the fact of having two identical pistons moving in opposite directions on each side of the axis of the cartridge allows a certain dynamic balancing to be obtained.

Figure 2:
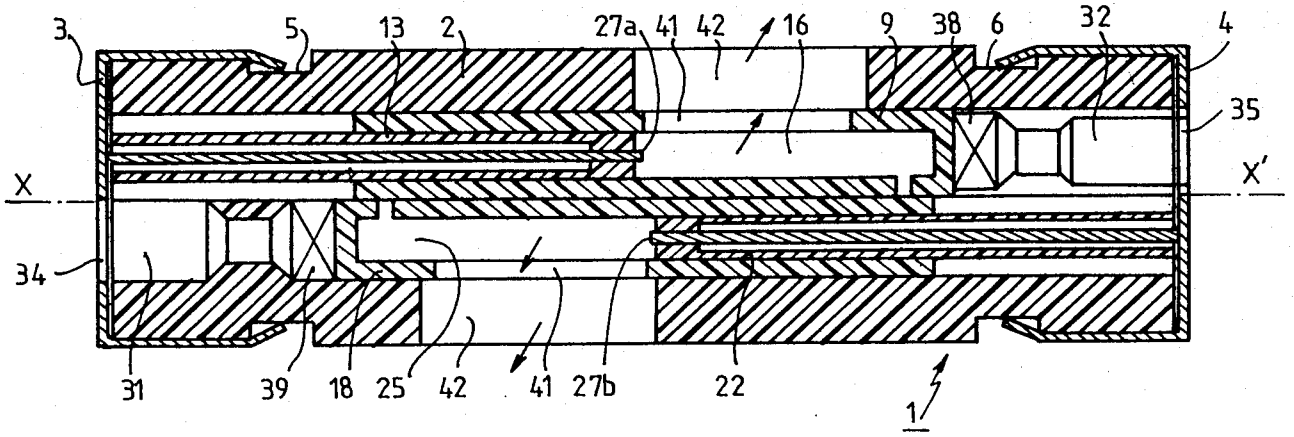

FIG. 2 shows the end of travel position of each of the two pistons once they have been propelled by the gases produced when the fuse wire 27 melts. After sliding along their associated fixed sleeves 13 and 22, the two pistons come into abutment respectively against two cylindrical tubes 31 and 32 disposed in the two housings of the body and aligned axially with the two pistons for receiving them at the end of travel. In order to drive out the volume of air displaced by the movement of each of the two pistons, the two tubes 31 and 32 communicate directly with the outside through openings, respectively 34 and 35, formed in the two end pieces 3 and 4.

It will be noted that at the end of travel of each piston (FIG. 2), the distance separating the two parts of the split fuse wire, references at **27*a* and 27*b* in FIG. 2**, is sufficiently large to prevent any restriking of an arc between these fuse wire portions, thus conferring thereon complete insulation.

Since the speed of movement of each of the pistons is relatively high, which is required for obtaining a good quality cut-out, means are provided for damping their end of travel movement without bouncing. These means are formed for example by two elastomer cushions 38 and 39 fixed for example by bonding, to the external surface of the respective bottoms of the two pistons.

In addition, after propulsion of each piston by the gases released by the electric arc, it has proved necessary to then discharge these gases so as to avoid any damage to the fuse cartridge. For this, as illustrated in FIGS. 1 and 2, the gas discharge means comprise, for each piston, a first aperture 41, for example oblong, formed laterally in the piston opposite its orifice, and a second aperture 42, for example identical to the first one and formed laterally in the body, so that after propulsion of each piston, these apertures 41 and 42 come opposite each other and thus allow the gases to escape. In FIG. 2 the different arrows show the path of the gases escaping to the atmosphere through these apertures.

Figure 3:
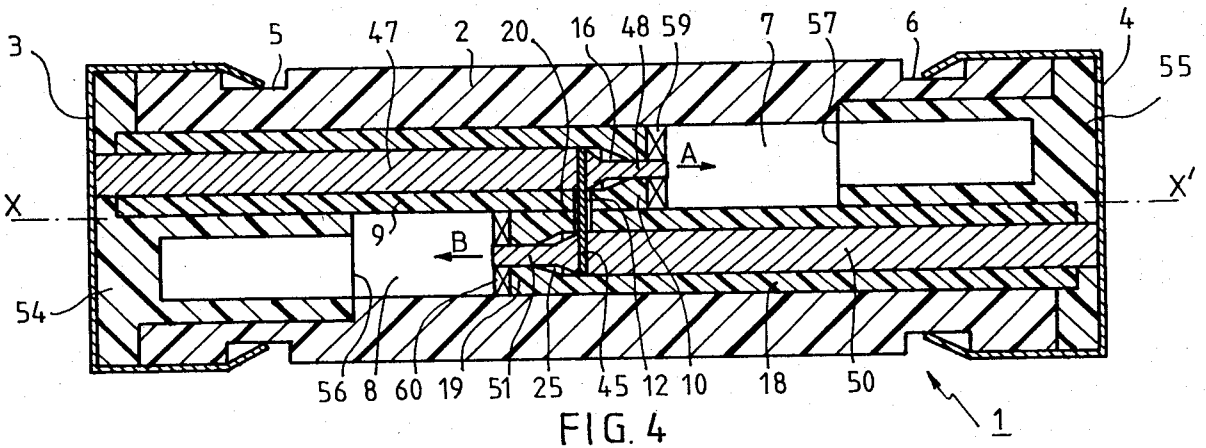
FIGS. 3 and 4 show longitudinal sectional views of a fuse cartridge variant of the cylindrical type in accordance with the invention, respectively with the pistons in the rest and end of travel positions.
Figure 4:
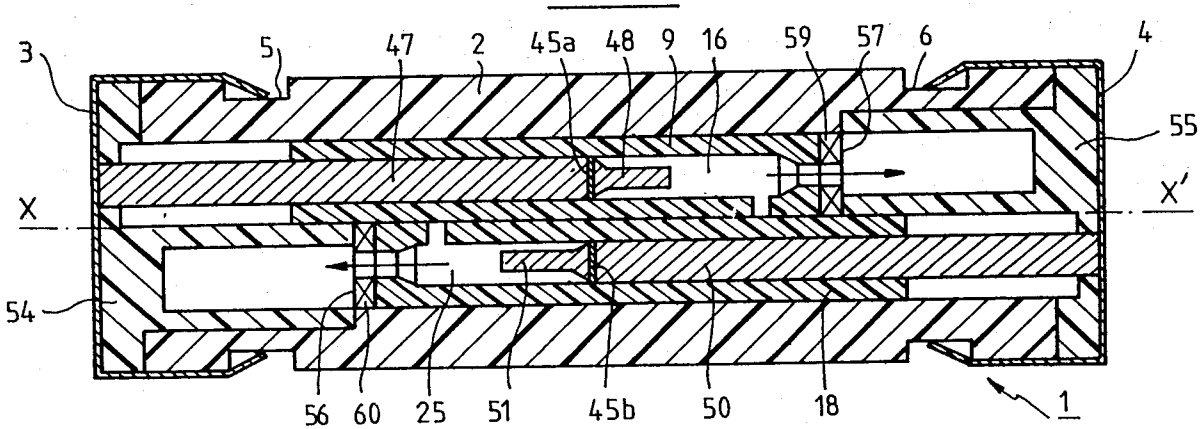

FIG. 3 shows in section a preferred variant of the fuse cartridge of cylindrical type 1 in accordance with the invention before appearance of the electric arc, whereas FIG. 4 shows the same cartridge in section after appearance of the arc which is sheared in a way quite identical to the one already described with reference to FIGS. 1 and 2.

Thus, in FIG. 3, this cartridge 1, with a rating for example of 12A/220 or 380 V, is formed of the cylindrical body 2 with axis XX' defining longitudinally two identical housings 7 and 8 each receiving one of the two pistons movable in opposite directions 9 and 18. As before, pistons 9 and 18 are identical and each are in the form of a cylindrical sleeve having a bottom, respectively 10 and 19, and pierced laterally with an orifice, respectively 12 and 20, which comes opposite its counterpart when the two pistons are in the rest position (FIG. 3).

Inside each piston is introduced longitudinally an assembly of two fixed axially aligned cylindrical support pieces, made from a conducting material such for example as silver coated copper and between which is gripped, transversely to their axis, a part of the fuse element formed for example by a conducting strip 45, so that at the end of assembly the fuse strip is disposed perpendicularly to the axis XX' while passing through the respective orifices 12 and 20 of the two pistons and being supported at both its ends by the two assemblies of fixed pieces associated respectively with the two pistons. Each assembly formed by the two support pieces gripping therebetween a part of the fuse strip is made into a unit for example by soldering these pieces together.

As is clear from FIG. 3, the two fixed pieces associated with piston 9 are formed respectively from a first cylindrical rod 47 fitted with a slight clearance in the piston substantially as far as its orifice 12 and being fixed at one of its ends, for example by soldering, to the conducting end piece 3 and from a second cylindrical rod 48 inserted in a central opening pierced in the bottom 10 of the piston and ending in a neck gripping, with the other end of the first rod, the fuse strip 45. This second cylindrical rod 48 has a diameter less than the internal diameter of the piston so as to define therein the space 16 of variable volume, called gas expansion space, which communicates with the orifice 12 of the associated piston 9.

Similarly, at 50 and 51 in FIG. 3 have been shown the two cylindrical support rods associated with the other piston 18, with the rod 50 fixed, for example by soldering, to the other conducting end piece 4, and with the rod 51 defining the internal space 25 of variable volume communicating with the orifice 20.

Figure 5:
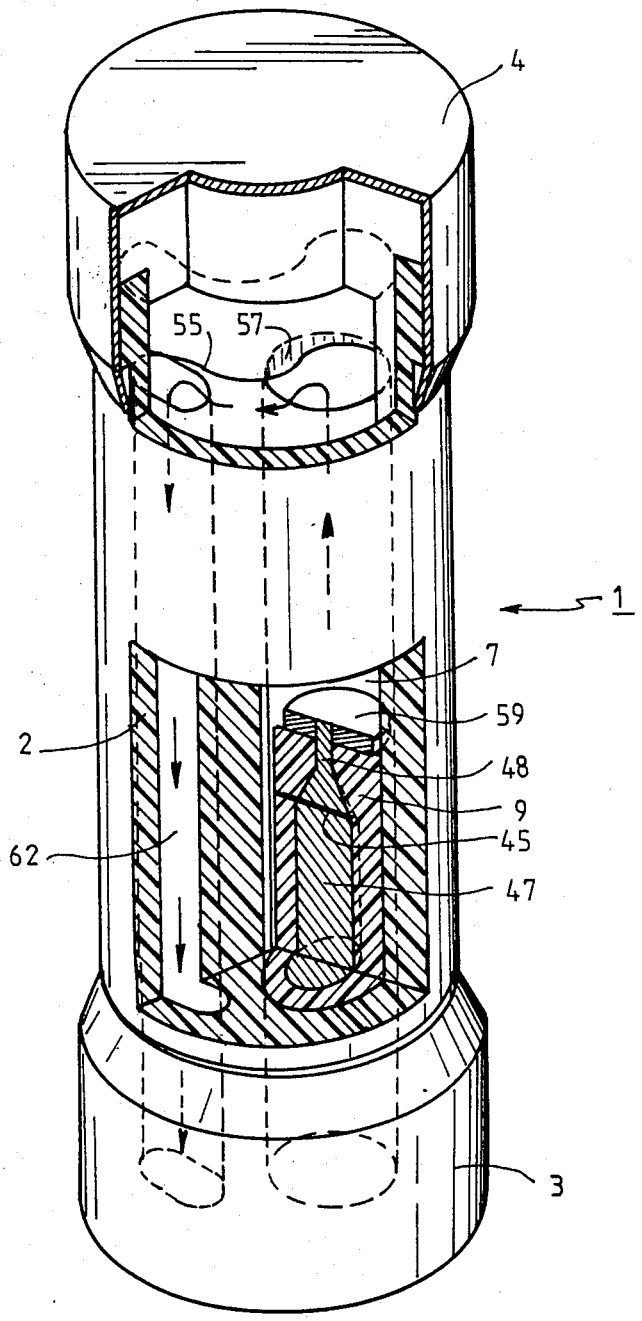
FIG. 5 shows a partial perspective view with parts cut away of the cartridge shown in FIGS. 3 and 4, showing the path of the gases for removing same after propulsion of a single piston illustrated.

This cartridge 1, illustrated in FIGS. 3 and 4, also comprises two intermediate cylindrical pieces 54 and 55 mounted respectively between the two ends of the body 2 and the two end pieces 3 and 4. These two pieces, only one of which is visible in FIG. 5, are each formed with two openings connected together by an internal duct transversal to the axis of the associated piston, and are each provided with a bearing surface forming a shoulder, respectively 56 and 57, formed at the level of the inlet of their duct and being positioned in the associated housing of the body provided for receiving the piston.

Thus, as before, when an overcurrent or a short circuit appears, the fuse strip splits into two parts (45*a*, 45*b* in FIG. 4) at the level of its housing in the two facing orifices, and the energy of the electric arc appearing between these two strip parts propels the two pistons in opposite directions as shown by the arrows A and B in FIG. 3.

At the end of travel illustrated in FIG. 4, the two pistons 9 and 18 come into abutment respectively against the two shoulders 56 and 57 of the two intermediate pieces and their movement is damped by means of two annular elastomer rings 59 and 60 fixed respectively, for example by bonding, to the external surface of their respective bottoms.

This cylindrical fuse cartridge variant is essentially distinguished from the preceding one by the fact that the gases propelling the pistons expand, not outwardly of the cartridge but inwardly of the cartridge itself.

For that, FIG. 5 illustrates the path followed by the gases expanding in the cartridge after propulsion of the single piston shown in this Figure, such for example as piston 9. It is obvious that the path followed by the gases propelling the other piston is symmetrical with respect to the axis of the cartridge of the one shown in FIG. 5.

Thus, when piston 9 is at the end of travel (FIG. 4), the gases released by the electric arc escape from the piston through a central opening formed in its bottom, then pass through the associated annular ring 59 and penetrate into the internal duct of the intermediate piece 55. On leaving this duct, the gases are discharged into another communicating duct, shown at 62 in FIG. 5, formed longitudinally in body 2 and at the end of which the gases are then sufficiently expanded. The different arrows in FIG. 5 illustrate the path followed by these gases for expansion.

Figure 6:
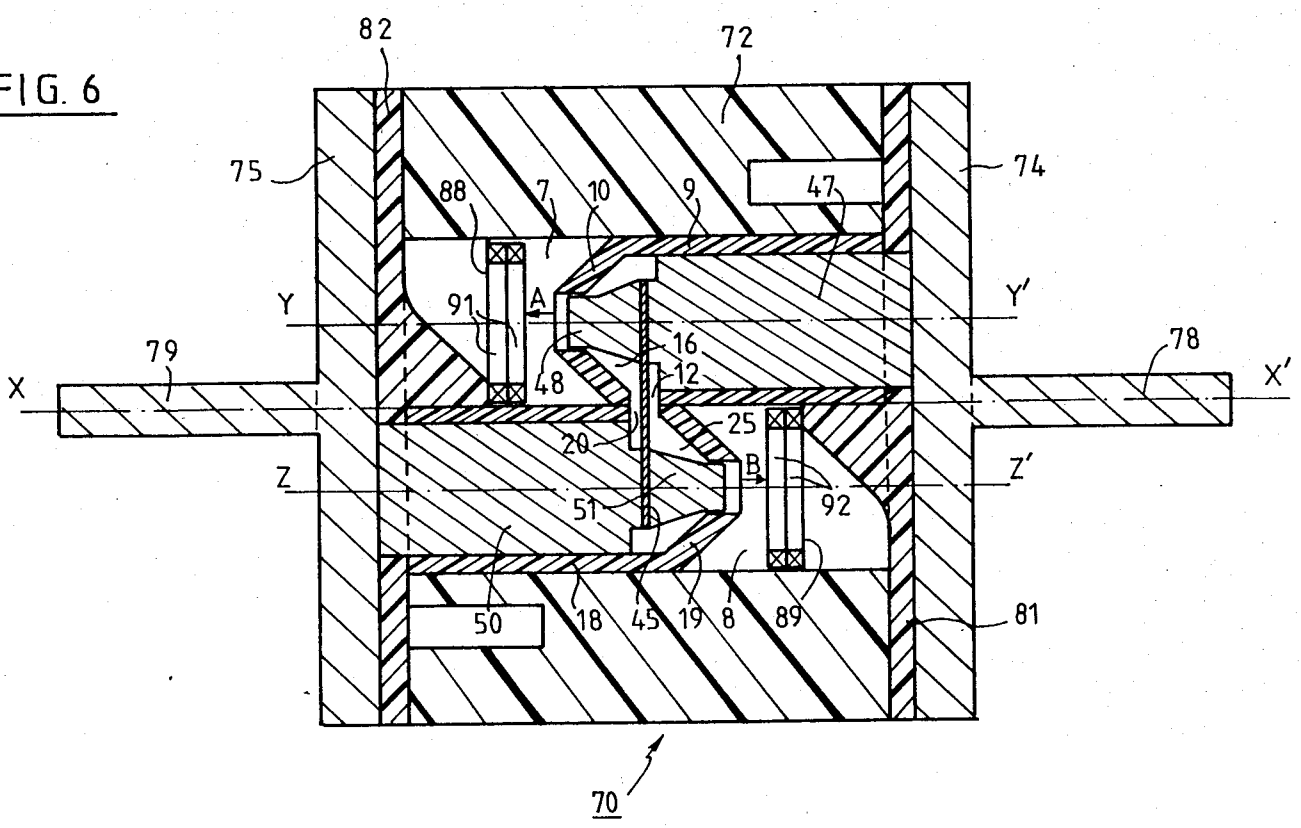
FIGS. 6 and 7 show longitudinal sectional views of one embodiment of a fuse cartridge of the knife type in accordance with the invention, respectively with the pistons in the rest and end of travel positions.
Figure 7:
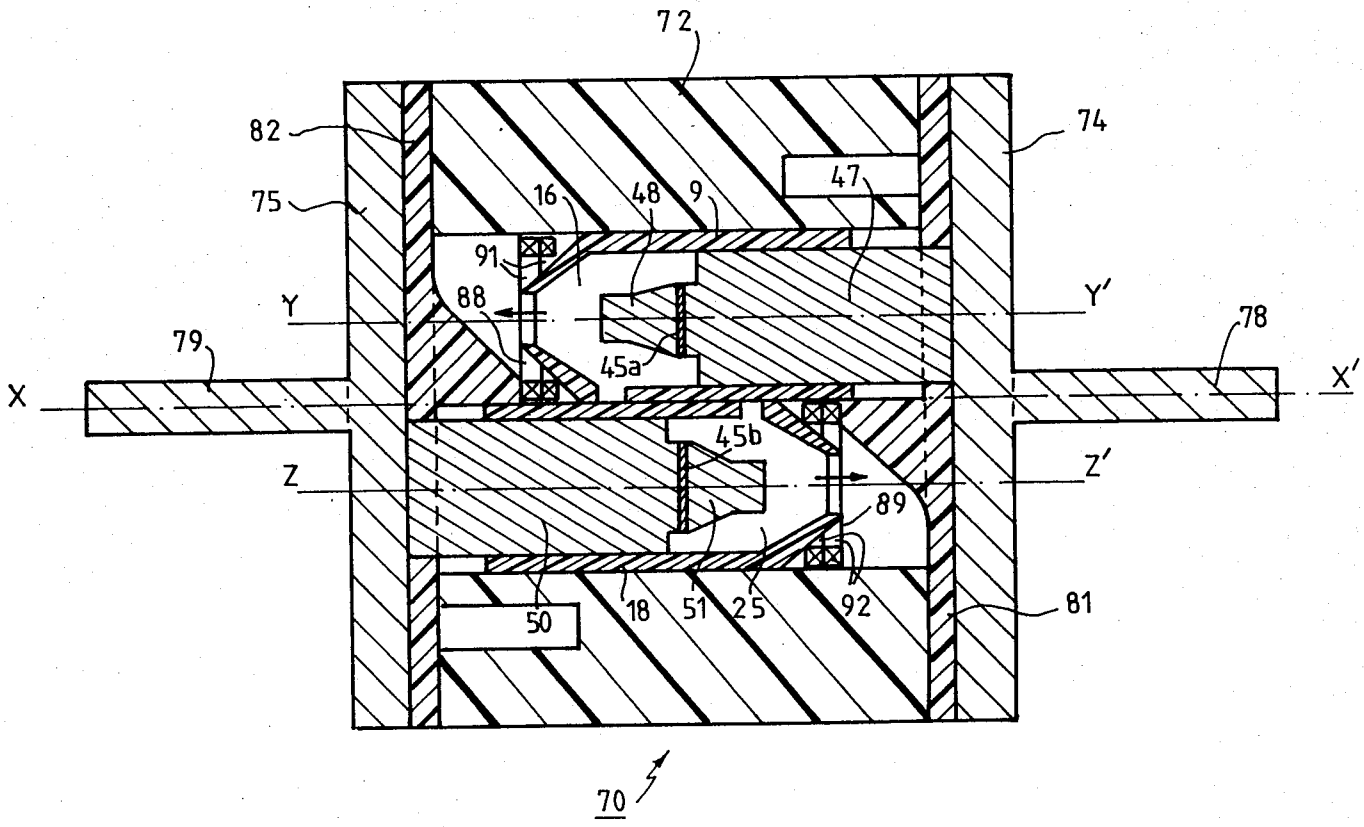

FIG. 6 shows in section a fuse cartridge of the knife type 70 in accordance with the invention before appearance of the electric arc and FIG. 7 shows this same cartridge in section after appearance of the arc which is sheared on the same principle as described above, namely by the movement in opposite directions of two pistons each propelled by the energy of the arc.

Thus, in FIG. 6, this knife cartridge 70, having a rating for example of 1000A/1000 V, comprises an insulating material parallelepipedic body 72, with axis XX', formed with two identical housings 7 and 8 receiving respectively the two pistons 9 and 18 mobile in opposite directions. These pistons are in the form of cylindrical sleeves, with respective axes YY' and ZZ', with respective bottoms 10 and 19 each pierced with a central opening. The pistons are also pierced laterally with orifices 12 and 20 communicating with each other at the level of axis XX' and through which the fuse element formed for example by the conducting strip 45 passes perpendicularly to this axis.

Similarly to the cartridge described with reference to FIGS. 3 and 4, this knife cartridge also comprises two assemblies comprising two fixed pieces each, between which is gripped a part of the fuse strip 45. At 47 and 50 have been shown the two cylindrical bars made from a conducting material fixed at one of their ends respectively to two conducting plates 74 and 75 and, at 48 and 51, the other two conducting bars forming plugs defining respectively the two internal spaces 16 and 25 of variable volume communicating with the orifices of the two pistons. As before, the two bars of the same assembly are fixed to a part of the fuse strip for example by soldering.

As is shown in FIGS. 6 and 7, the two end pieces or knives 78 and 79 made from a conducting material are mounted perpendicularly to the two plates 74 and 75 at the level of axis XX' and are fixed thereto for example by welding. It will be noted that each plate with its knife may be formed as a single piece.

Figure 8:
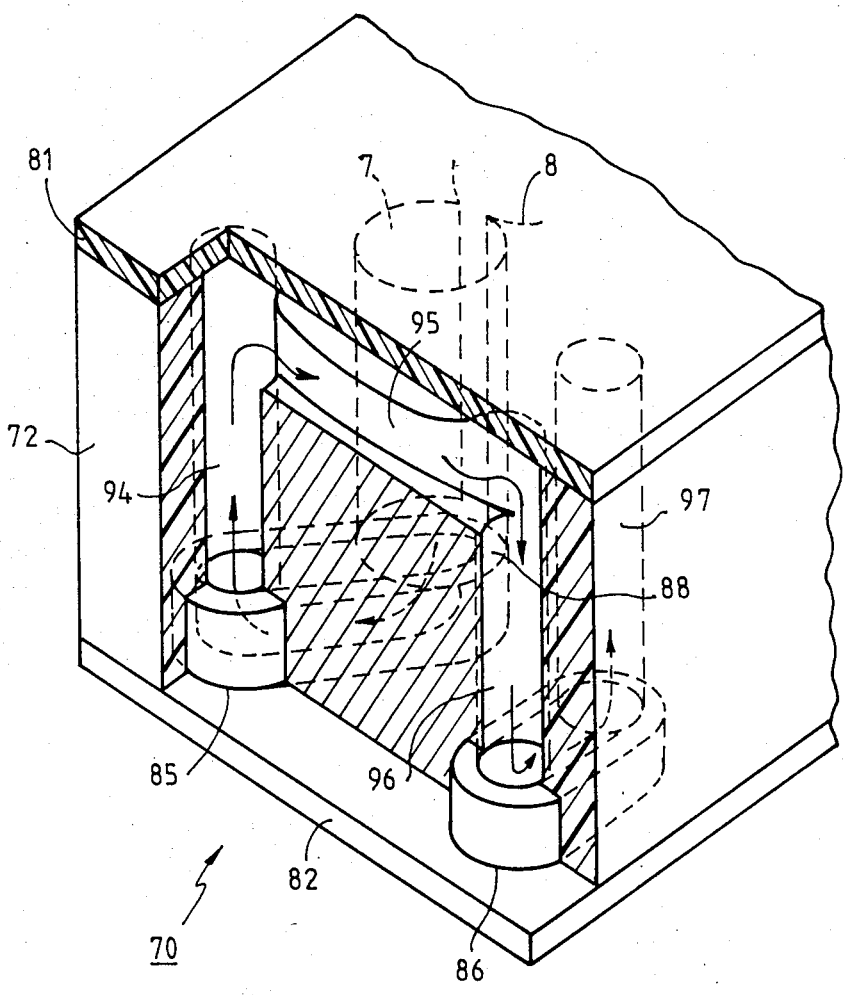
FIG. 8 shows a partial perspective view with parts cut away of the cartridge shown in FIGS. 6 and 7, showing the path of the gases for removing same after propulsion of a piston.

The knife cartridge 70 also comprises two plates forming insulating bases 81 and 82 disposed respectively between the body 72 and the plates 74 and 75 and on each of which are fixedly mounted pieces forming insulating heels, for example two in number, referenced at 85 and 86 in FIG. 8. For the sake of clarity, only the two heels of base 82 have been shown, those of base 81 being disposed symmetrically with respect to an axis perpendicular to axis XX'.

In FIG. 8, the two heels 85 and 86 are each pierced with two openings connected together by an internal duct by positioning the inlet of the duct in heel 85 opposite the housing provided for piston 9. In addition, this inlet of the duct has a part forming a shoulder 88 (FIG. 8) for receiving the piston 9. At 89 in FIG. 6 has been shown the shoulder for receiving the other piston 18.

As before, when an overcurrent or a short circuit appears, the fuse strip splits into two parts (45*a*, 45*b* in FIG. 7) and the energy of the electric arc appearing between these two strip parts propels the two pistons in opposite directions shown by the arrows A and B in FIG. 6. At the end of travel shown in FIG. 7, the two pistons come into abutment against the two shoulders 88 and 89 of the two similar heels, and their movement is damped by means of several identical annular elastomer rings 91 and 92 fixed for example by bonding to said shoulders.

FIG. 8 shows mainly the path followed by the gases expanding inside the cartridge after propulsion of one of the pistons. It will of course be readily understood that the path of the gases propelling the other piston is symmetrical to the one shown in this FIG. 8.

Thus, when the piston, for example 9, is at the end of travel (FIG. 7), the gases released by the electric arc escape from the piston through its central opening then pass through the damping rings 91 and expand in an assembly of ducts connected to each other and comprising those formed in the heels 85 and 86 and four other ducts, referenced at 94, 95, 96 and 97 in FIG. 8, formed in body 72. This gas expansion path is illustrated by the different arrows in FIG. 8.

It will be noted that it is also possible to fit at the end of each piston a spring (not shown) with appropriate elasticity which participates, on the one hand, in release of the piston particularly in the case of low overcurrents and, on the other hand, in damping the movement thereof at the end of travel without bouncing, without departing from the spirit of the invention.

Of course, the invention is in no wise limited to the embodiments described and shown and comprises all the technical equivalents of the means described as well as combinations thereof if they are effected in the spirit of the invention and used within the scope of the following claims.

What is claimed is:

1. A fuse cartridge comprising an insulating material body with longitudinal axis, having two opposite end faces perpendicular to said axis and comprising respectively two end pieces made from a conducting material and a fuse element connected electrically to the two end pieces, further comprising:

two insulating pistons housed in the body parallel to the axis thereof and movable in translation in opposite directions from each other between a rest position assumed before appearance of an electric arc and a position in which the arc is sheared, the two pistons being pierced laterally, respectively, with two orifices coming opposite each other and having passing therethrough a reduced section portion of the fuse element when the pistons are in the rest position, each orifice communicating with an expansion volume space defined inside the associated piston and intended for collecting gases produced during melting of the fuse element, so that when the electric arc produced by the melting fuse element appears in the orifices, the pressure of the gases released by the arc exerts on each of the pistons a force which causes movement thereof in opposite directions towards the position where the arc is sheared;

stop forming means housed in the body and associated with each piston for receiving this latter at the end of travel;

means for discharging the gases after propulsion of each piston.

2. The cartridge as claimed in claim 1, wherein each gas expansion volume space is defined inside the associated piston by means of at least one fixed piece supporting the fuse element and housed in the piston.

3. The cartridge as claimed in claim 1, wherein the two mobile pistons are identical and are disposed with a small clearance with respect to each other.

4. The cartridge as claimed in claim 1, comprising means for damping the movement of each piston at the end of travel, disposed between the piston and the stop forming means.

5. The cartridge as claimed in claim 2, wherein the body is cylindrical in shape, each mobile piston is formed by a first cylindrical sleeve provided laterally with said orifice and able to move axially in the body, each fixed support piece is formed by a second cylindrical sleeve made from an insulating material, of a length less than the first sleeve and insertable therein, each of the first and second sleeves being closed for defining said gas expansion volume space and said fuse element is formed by a wire passing through the orifice of each first sleeve as well as the associated expansion volume space and penetrating into the second associated sleeve through a central opening.

6. The cartridge as claimed in claim 5, wherein said fuse wire has a reduced section where it passes through said orifice and said associated expansion volume space of each first sleeve.

7. The cartridge as claimed in claim 1, wherein the stop forming means comprise a cylindrical tube associated with each mobile piston and axially aligned therewith, this tube communicating directly with the outside through an opening formed in one of the end pieces.

8. The cartridge as claimed in claim 4, wherein the means for damping the movenet of each piston comprise an elastomer cushion fixed to an end of the piston.

9. The cartridge as claimed in claim 1, wherein the means for discharging the gases after the propulsion of each piston comprise a first aperture formed in a lateral face of the piston which is opposite that provided with the orifice and a second aperture formed laterally in the body so that after propulsion of the piston these first and second apertures come opposite each other so as to allow the gases contained in the expansion volume space to escape therethrough.

10. The cartridge as claimed in claim 2, wherein the body is cylindrical in shape, each mobile piston is formed by a cylindrical sleeve provided laterally with said orifice and able to move axially in the body, the sleeve comprising an end face pierced with a central opening, the fuse element is formed by a strip and each fixed support piece comprises two cylindrical rod means made from a conducting material, aligned axially and fixed together and between which a part of the strip is fixedly mounted, these two rods being insertable in the associated sleeve with one of them defining said gas expansion volume space with the sleeve on its end face side and the other rod being fixed at its end to one of the end pieces, each sleeve sliding along the rod fixed to the associated end piece when the electric arc appears.

11. The cartridge as claimed in claim 1, wherein said means for discharging the gases after propulsion of each piston comprise an assembly of ducts communicating with each other formed some in the body and others in two intermediate cylindrical pieces which are mounted in the body respectively between the two ends thereof and the two end pieces.

12. The cartridge as claimed in claim 1, wherein said stop forming means comprise a shoulder forming part formed in each intermediate piece positioned in the body provided for each piston.

13. The cartridge as claimed in claim 4, wherein said means for damping the movement of each piston comprise an annular elastomer ring fixed at an end of the piston and communicating with the central opening.

14. The cartridge as claimed in claim 2, wherein the body is substantially parallelepipedic in shape, each end piece is formed by a plate on which a knife forming piece is mounted perpendicularly, each mobile piston is formed by a cylindrical sleeve provided laterally with said orifice and able to move axially in the body, the sleeve comprising an end face pierced with a central opening, the fuse element is formed by a strip and each fixed support piece comprises two elements forming cylindrical bars made from a conducting material, aligned axially and fixed together and between which is fixedly mounted a part of the strip, these two bars being inserted in the associated sleeve with at least one of them defining said gas expansion volume space with the sleeve on the end face side thereof while the other bar is fixed at its end to the plate of one of the end pieces, each sleeve sliding along the bar fixed to the plate of the associated end piece when the electric arc appears.

15. The cartridge as claimed in claim 1, wherein the means for discharging the gases after propulsion of each piston comprise an assembly of ducts communicating with each other, some provided in the body and others in parts forming heels mounted fixedly on two bases disposed respectively between the two ends of the body and the two ends of the pieces, one of the heels of each base having a duct whose inlet is placed opposite the housing provided for each piston for receiving therein the gases released by the arc.

16. The cartridge as claimed in claim 1, wherein the stop forming means comprise a shoulder forming part at the level of the inlet of its duct which communicates with the housing of the body provided for each piston.

* * * * *